United States Patent [19]

Allen et al.

[11] 4,099,271

[45] Jul. 11, 1978

[54] LIGHTWEIGHT COSTUME HEAD

[76] Inventors: Terry Mark Allen, 2526 Commonwealth, Salt Lake City, Utah 84109; William Duane Derfler, 10536 Whitesands, Sandy, Utah 84070

[21] Appl. No.: 575,496

[22] Filed: May 8, 1975

[51] Int. Cl.[2] ..... A42C 1/00

[52] U.S. Cl. ..... 2/192; 2/173; 2/205

[58] Field of Search ..... 2/206, 202, 205, 173, 2/171, 192, 195, 201; 128/516

[56] References Cited

U.S. PATENT DOCUMENTS

| | | | |
|---|---|---|---|
| 1,845,279 | 2/1932 | Iwan | 2/201 |
| 2,066,713 | 1/1937 | Bowland | 2/205 X |
| 2,632,174 | 3/1953 | Lyon | 2/192 X |
| 2,666,204 | 1/1954 | Mafko | 2/206 |
| 2,795,796 | 6/1957 | Ray | 2/202 X |
| 3,014,221 | 12/1961 | Brunetto | 2/205 |
| 3,295,511 | 1/1967 | Crouzet | 2/205 X |
| 3,440,660 | 4/1969 | Krinke | 2/202 X |
| 3,725,956 | 4/1973 | Reisen | 2/205 X |

FOREIGN PATENT DOCUMENTS

| | | | |
|---|---|---|---|
| 343,088 | 4/1936 | Italy | 2/192 |
| 476,251 | 12/1937 | United Kingdom | 2/206 |

*Primary Examiner*—Werner H. Schroeder
*Assistant Examiner*—Peter Nerbun
*Attorney, Agent, or Firm*—Trask & Britt

[57] ABSTRACT

A lightweight costume head having a hollow foundation constructed from thin slabs of foamed, elastomeric sections adhered together having an access opening and generally a cloth covering enveloping said foundation is described. The foundation generally has eye openings and may have a nose-mouth opening. The foundation comprises at least five sections cut from the flat slab of a foamed elastomer to form a head shape, frequently a spherical shape from identical sections adhered along their edges.

2 Claims, 5 Drawing Figures

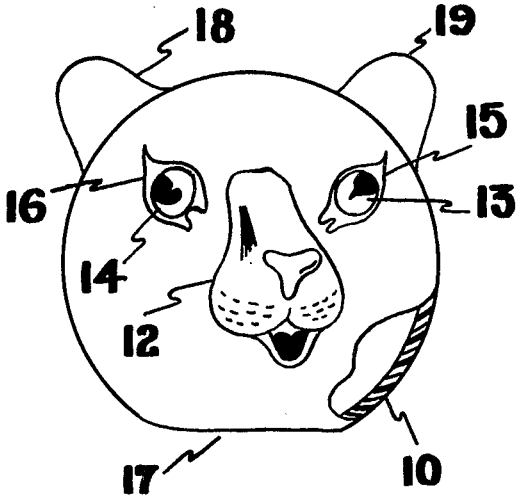
FIG. 1
FIG. 2
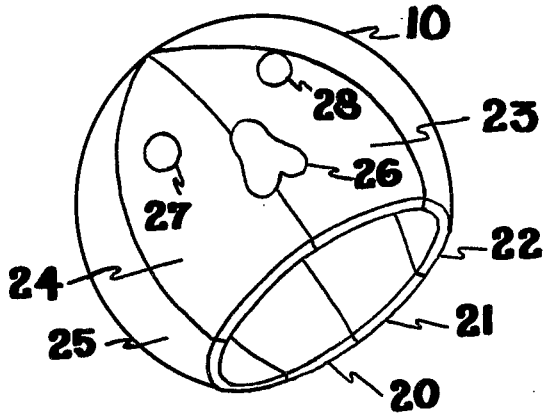
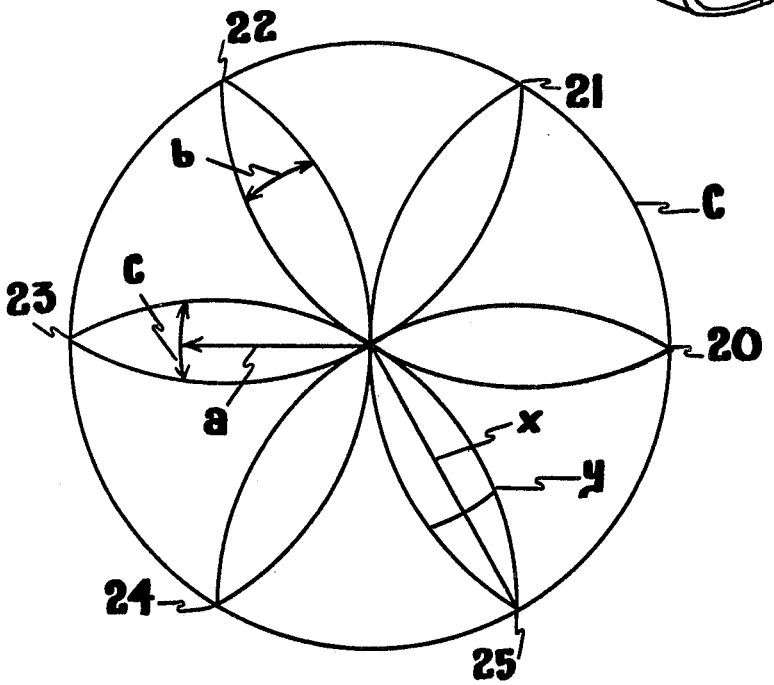
FIG. 3

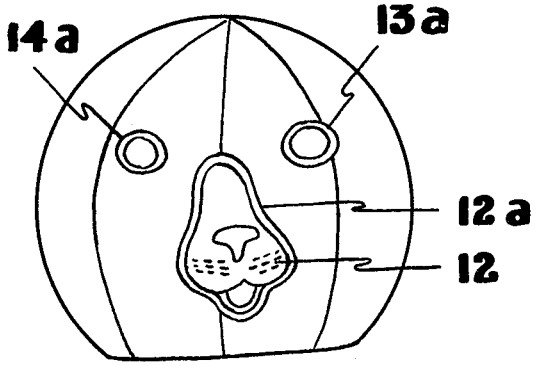
FIG - 4
FIG. 5
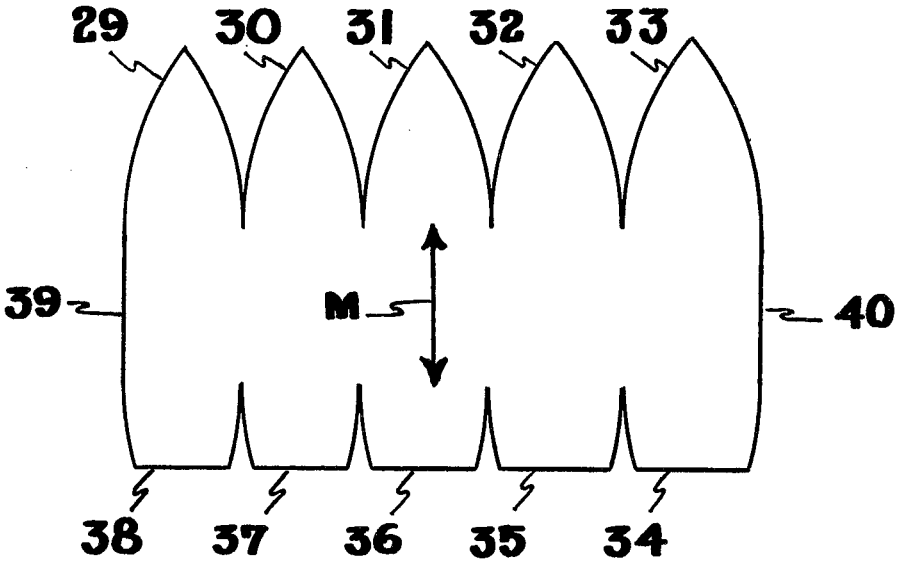

LIGHTWEIGHT COSTUME HEAD

BACKGROUND OF THE INVENTION

1. Field

This invention relates to full head costume masks wherein the head of the wearer is inserted through an access opening in the mask.

2. Prior Art

Full head costume masks have traditionally been made of papier-mache to form a lightweight head. The papier-mache is placed wet over a from. Upon drying, the papier-mache mask may be painted, covered with cloth, etc. The papier-mache mask requires a form for construction and is relatively fragile since it is thin and rigid and must be carefully packed for shipping.

More durable masks have been constructed of thin sheets of a thermoplastic material. The sheets are heated until soft, then molded about a form. Upon cooling the sheets adhere together to form a strong, rigid mask which is substantially heavier and stronger than a papier-mache mask. Although a rigid plastic mask is stronger than a papier-mache mask, it also requires careful packing for shipping.

Masks of a lightweight form material have been constructed of thick sections of foam adhered together to form a box-like structure which is then carved or sculptured to form a head shape with an internal cavity. The carving of such a costume head requires considerable skill and is time consuming.

OBJECTS OF THE INVENTION

It is an object of the instant invention to provide a lightweight, durable costume head.

A further object of the invention is to provide a crushable, easily shippable costume head.

Another object is to provide an easily constructed costume head requiring no sculpturing nor forms for fabrication.

A further object of the invention is to provide a costume head which is easily cleaned and maintained.

DESCRIPTION OF THE DRAWINGS

Reference is made herein to the following figures:

FIG. 1 is a perspective view of a costume head mask;

FIG. 2 is a perspective view of a foamed elastomeric mask foundation;

FIG. 3 is a plan view of foamed elastomeric sections formable into a substantially spherical mask foundation;

FIG. 4 is an elevational view of a substantially spherical mask foundation illustrating the attachment of a nose-mouth component and transparent eye pieces; and FIG. 5 is a plan view of a sheet with fringes cut therein so that the sheet can be joined into a substantially spherical shape.

DESCRIPTION OF THE INVENTION

The instant invention comprises a costume head having a flexible, crushable, hollow foundation having an access opening and optionally eye openings and an opening for a snout piece. Transparent eye pieces and a rubbery, hollow snout component are frequently attached to the foundation to provide a life-like appearance. A cloth covering generally encloses the foundation. The advantage of the instant construction is that it may be rapidly constructed from sections cut from flat slabs without requiring any sculpturing or requiring any forms for construction.

The significant advantages of the instant invention are that elastomeric foam foundations which are lightweight and crushable may be readily formed from flat, thin slabs of foam material by cutting and gluing of sections together to form a substantially spherical head shape. Eye and nose-mouth openings may be cut in the foundation although the mask may be one which is worn above the head of the user and the wearer may see and breath through a neck portion in which a screen is placed. Generally, however, eye holes and a snout hole are cut in the foam foundation. The cloth covering may be readily fitted over the foam foundation and may even contain a zipper so that the cloth covering can be easily removed from the foam foundation for cleaning and repair. Although a lightweight, molded, rubber snout portion is frequently adhered to the foundation a snout or nose-mouth formed of foam may be added to the foundation and covered with cloth.

The foundation of the costume head is preferably constructed of sections of foamed elastomeric slabs. A preferred construction comprises adhering six or more orange-slice or leaf sections of a flat elastomeric foam having a thickness of about one-half to about two inches together along elongated edges to form a substantially spherical shape having a bottom access opening. The flexible, elastomeric foam sheets are of polyurethane, foam rubber or the like which are of the type available commercially for seat cushions and the like. An open celled foam is preferably utilized inasmuch as some air passage through the foundation walls occurs adding to the comfort of the wearer. The foam is lightweight, having a density of less than 5 pounds per cubic foot and preferably less than about 3 pounds per cubic foot.

The costume heads are cloth covered. Since animal heads are typically popular costume heads, the cloth covering is frequently a simulated fur or hair covering. Since the foundation is crushable, the cloth covering may be easily removed for cleaning.

A particular advantage of the costume heads of the instant invention is that a number of different appearing heads may be made from the same lightweight elastomeric foam foundation. A substantially spherical foundation is a preferred construction inasmuch as lightweight foam slabs contribute good structural support when combined to form a hollow sphere with an access opening for the head of the wearer. Attachment of different appearing snouts (nose-mouth components) of hollow, molded rubbery material, when combined with a suitable cloth covering, can provide costume heads having the appearance of pigs, cats, lions, tigers, birds and the like from the same type foundation. Addition of transparent pieces of a particular shape or with selective coloring of a particular design for the different animals gives a more life-like appearance.

A further significant advantage of the costume heads of the instant invention is that no special forms or molds are required, except for forming the snout portions. The costume head foundation can be constructed from readily available commercial materials and assembled without any special assembly jigs, molds, dies or the like. Assembly techniques are described hereinafter.

A typical costume head is illustrated in FIG. 1 depicting the features of a cat. A cut-away section of the cloth covering 11 exposes the elastomeric foam foundation 11. A snout portion 12 having the nose and mouth features of a cat is attached to the substantially spherical foundation and overlapped slightly by the cloth covering. Transparent eye pieces 13 and 14 are also attached to the foundation. Eye trim pieces 15 and 16 attached around the eye pieces to further accentuate the cat-like characteristics of the mask. An access opening 17 is located at the bottom of the mask. Ear members 18 and 19 are attached to the cloth covering 11 and have internal support to keep the ears in a substantially vertical condition.

The flexible foundation 10 is illustrated in FIG. 2 which shows six foam sections 20, 21, 22, 23, 24 and 25 joined along their longer edges to form a substantially spherical hollow shell having an opening 17 in the base thereof. Both the exterior and interior surfaces of said foundation are substantially spherical. A snout opening 26 and eye openings 27 and 28 are also provided in the foundation. Although the foam slabs do not have sufficient structural strength to maintain the slab in a vertical position when placed on an edge, the joining of the elongated edges of the slabs together forms a substantially spherical shape of good structural integrity. Although more than six elliptical sections can be joined to form the foundation, the cutting and assembling of more than six sections requires additional effort. Six sections are sufficient, and five may be utilized, to form a spherical construction, which is generally a preferred head shape.

A layout of six foam sections to form a foundation is illustrated in FIG. 3. The sections have a length "*a*" which is generally from about 14 to about 18 inches. The sections have a maximum width "*b*" of from about 5 to about 8 inches. The arc "*c*" is generally from about 3 to about 5 inches in length and forms the collar about the access opening to the costume head. A pattern for cutting the foam foundation and the cloth covering may be laid out as illustrated in FIG. 3. The length of chord "*x*" is the radius of circle "C". Chord "*x*" is preferably from about 20 to about 28 inches, which gives a circumference of an assembled costume head of from about 40 to about 56 inches, i.e., twice the distance of "*x*". A preferred circumference is about 48 inches. The chord "*x*" is three times "*a*" when the arc "*y*" has the same radius as circle "C".

A single pattern is sufficient for cutting out six sections of the shape "*abc*". The six sections are then joined at the apex "A", as illustrated in the pattern of FIG. 3. The arcs "*y*" are then joined, by gluing or other appropriate means, including heat sealing, to form a substantially spherical foundation having an access opening having a circumference equivalent to six times the distance "C".

The flexible foam utilized for the foundation generally has a thickness of from about ½ to about 2 inches and preferably from about ¾ to about 1¼ inches. A 1 inch thick foam is utilized with particularly good results. The edges of the foam section may be bevelled slightly so that the inner area or a leaf section is slightly less than the external area, however, bevelling is not necessary with the flexible foam in order to get a well shaped costume head inasmuch as the flexible foam compresses slightly as the edges of the sections are joined and the spherical shape is formed. This would not be possible if a rigid material were used or if a flexible solid material were used. Thus, the use of a flexible cellular compressible material permits rapid cutting of the leaf-like sections without bevelling or other subsequent shaping operations.

After the foam foundation is formed as described hereinafter, openings are cut therein for the snout piece and for eye openings. A snout piece, which is generally formed from a soft, thin rubbery material is then glued or adhered to the exterior of the foam foundation to cover snout opening. Eye pieces are generally preferred and are adhered over the eye openings. The eye pieces preferably have at least a portion thereof which is transparent. The snout piece preferably has either nostril openings or a mouth opening, or both, to facilitate the breathing and comfort of a wearer.

After the snout piece and eye pieces have been adhered to the foundation, the cloth covering is added. The cloth covering is preferably made from the same number of leaf-like sections as the foundation, which are slightly larger than the foundation sections to facilitate stitching to form an enveloping structure which is slipped over the foundation. The cloth covering can be completely stitched in an inside-out condition, then turned, or batted, zippered, snapped, buttoned, etc., at desirable locations, the foundation crushed and the cloth covering pulled on over the crushed foundation. The holes for the snout piece and eyes are preferably pre-cut in the cloth covering so that the cloth covering slightly overlaps the snout and eye pieces to conceal the joints between the foundation and the eyes and snout. The cloth covering does not require securing to the foundation otherwise. Ear members may be attanched to the cloth covering, either before or after it is fitted to the foundation, although such attachment is facilitated if done before the cloth covering is fitted over the foundation.

The costume masks of this invention are particularly advantageous inasmuch as the masks may be formed of readily available materials, which are easily cut and assembled into a foundation and covering. Specially molded pieces are limited to the snout and eye pieces. The foundations can be the same for a great number of head designs, and the head shape may be altered from a spherical shape by cutting the leaf-like sections narrower or fatter to make oblong shapes, or by cutting one of the ends of the leaf-like sections narrower or fatter to make an irregular shape. A lateral cross-section through any portion of the mask preferably subscribes a circle, even for oblong or irregular shaped heads.

Significant advantages of these costume heads are their lightweight, breathability, crushability and cleanability. Costume heads of papier-mache, rigid plastics and the like, are generally fragile or heavy, and are generally painted, so that the flow of air into the interior of the mask is restricted. Papier-mache or plastic heads covered with cloth usually have the cloth glued onto the foundation, which renders it difficult to remove the cloth for cleaning.

The masks of this invention are unique in that they may be crushed for packaging and shipping, then popped into shape for wearing. Also, since large, full head masks are frequently rented rather than purchased, the likelihood of damage to masks to the instant invention in much less than experience with papier-mache masks. The lightweight and crushability of these masks permits them to be shipped in compact containers without high shipping rates accompanying large volume or heavy containers.

The masks of this invention are lightweight and easy to wear. A pad or headband may be attached to the interior wall of the masks to position the mask on the head of the wearer. Papier-mache and plastic heads are heavy and usually rest on the shoulders of the wearer so that the whole body must be turned to turn the head. The lightweight heads of this invention may be supported by a headband so that the mask turns as the wearer turns his head.

The attachment of the snout and eye pieces to the foam foundation is illustrated in FIG. 4. The snout piece 12 has a flat rim or flange 12*a* about the perimeter of the snout. The snout is larger than the opening in the foundation. The flange is glued or adhered to the face of the foundation to conceal the opening in the face. Flanges 13*a* and 14*a* similarly encircle the eye pieces and are glued or adhered to the foundation face to conceal completely the eye holes. The cloth covering is cut so that flanges 12*a*, 13*a* and 14*a* are hidden.

The illustration of FIG. 5 shows a pattern cut from a thin foamed sheet which can be joined together to form a substantially spherical head foundation. The pattern has long fingers or fringes 29 through 33 which can be joined along their edges to form the dome portion of the head while stub projections 34 through 38 can be joined to form the base portion of the head and by joining edges 39 and 40, a substantially spherical head may be formed. The mid portion of band having a width "*m*" need only be sufficiently wide to prevent the cuts or darts forming the fingers and stubs from tearing into one another.

Although a substantially spherical foundation may be utilized as a base for forming a great many of different types of costume heads, it is occasionally desirable to form more complicated shapes of costume heads such as frogs, alligators and the like. A more complicated shape can be formed from thin flat slabs of foam by cutting several sections from the foam to join together in the same fashion as described above. The development of an intricate pattern from which the sections may be cut has generally presented a problem. One effective technique for developing such patterns is to sculpture a small head of the shape desired then dip same in a latex and allow the latex to dry to form a rubbery, removable cover. The latex cover may be removed, by cutting, if necessary, and then cut into sections with darts in appropriate places so that a plurality of latex sections are obtained which lie flat when joined together along the dart to form the sculptured shape. The pattern then may be enlarged as necessary and thin foam slabs cut of the intricate pattern and joined together to form an intricate shape resembling but larger than the sculptured model.

As evident from the plan illustrated in FIG. 5 and from the description of cutting of patterns of an intricate shape to form an intricate head shape, the costume head foundations may be formed from only a single thin slab or elastomeric foam which is cut in a sufficient number of places that it may be joined together to form a three-dimensional head, generally having a portion thereof as substantially spherical. As indicated hereinabove, a substantially spherical head is preferably formed from at least five sections, which are preferably orange-slice of leaf-like sections or from a single slab which has at least eight darts cut therein to form fingers or fringes which may be joined together to form a substantially spherical head. In general, the formation of a substantially spherical head, even one of intricate shape, will be formed from one or more sections in which at least twelve darts are cut therein to form the shape. This is evident from FIG. 5, wherein at least twelve cuts must be made into the sheet in order to form a pattern which can be formed into a three-dimensional foundation of a substantially spherical shape.

We claim:

1. A method of forming a substantially spherical hollow shape from a flat elastomeric foam slab comprising:

(a) sculpturing a small scale model of the head shape desired;

(b) completely covering said sculptured model with latex and allowing same to dry;

(c) removing said latex shell from said model;

(d) cutting said latex shell into a number of sections and placing darts in same so that said latex sections become flat patterns;

(e) magnifying and transferring the latex pattern onto thin flat foam material;

(f) cutting the foam material into the desired patterns and joining the pattern sections together to form a costume head of substantially the same shape as the sculptured model.

2. The method of claim 1 wherein said thin flat foam material is about one inch in thickness.

* * * * *